US007113909B2

(12) United States Patent
Nukaga et al.

(10) Patent No.: US 7,113,909 B2
(45) Date of Patent: Sep. 26, 2006

(54) VOICE SYNTHESIZING METHOD AND VOICE SYNTHESIZER PERFORMING THE SAME

(75) Inventors: Nobuo Nukaga, Tokyo (JP); Kenji Nagamatsu, Kokubunji (JP); Yoshinori Kitahara, Tachikawa (JP)

(73) Assignee: Hitachi, Ltd., Tokyo (JP)

( * ) Notice: Subject to any disclaimer, the term of this patent is extended or adjusted under 35 U.S.C. 154(b) by 968 days.

(21) Appl. No.: 09/917,829

(22) Filed: Jul. 31, 2001

(65) Prior Publication Data

US 2002/0188449 A1 Dec. 12, 2002

(51) Int. Cl.
*G10L 13/00* (2006.01)

(52) U.S. Cl. ..... 704/258; 704/260; 704/261; 704/268; 704/267; 434/185

(58) Field of Classification Search ..... 704/258, 704/260, 261, 268, 270, 267; 434/185
See application file for complete search history.

(56) References Cited

U.S. PATENT DOCUMENTS

| | | | | |
|---|---|---|---|---|
| 5,636,325 | A * | 6/1997 | Farrett | 704/258 |
| 6,029,132 | A * | 2/2000 | Kuhn et al. | 704/260 |
| 6,081,780 | A * | 6/2000 | Lumelsky | 704/260 |
| 6,366,883 | B1 * | 4/2002 | Campbell et al. | 704/260 |
| 6,470,316 | B1 * | 10/2002 | Chihara | 704/267 |
| 6,499,014 | B1 * | 12/2002 | Chihara | 704/260 |
| 6,725,199 | B1 * | 4/2004 | Brittan et al. | 704/258 |
| 6,810,379 | B1 * | 10/2004 | Vermeulen et al. | 704/260 |
| 6,823,309 | B1 * | 11/2004 | Kato et al. | 704/267 |

FOREIGN PATENT DOCUMENTS

JP 11-249677 9/1999

OTHER PUBLICATIONS

Transaction of the Institute of Electronics, Information and Communication Engineers, 1984/7, vol. J67-A, No. 7, "Phoneme Duration Control for Speech Synthesis by Rule", pp. 629-636.
The Journal of the Acoustic Society of Japan, vol. 51, No. 1, pp. 1-13, "A Morphological Analyzer for a Japanese Text-to-Speech System Based on the Strength of Connection Between Two Words".
Journal of the Acoustical Society of Japan, 1999, "On the Control of Prosody Using Word and Sentence Prosody Database", pp. 227-228.

* cited by examiner

*Primary Examiner*—Vijay B. Chawan
(74) *Attorney, Agent, or Firm*—Mattingly, Stanger, Malur & Brundidge, P.C.

(57) ABSTRACT

A stereotypical sentence is synthesized into a voice of an arbitrary speech style. A third party is able to prepare prosody data and a user of a terminal device having a voice synthesizing part can acquire the prosody data. The voice synthesizing method determines a voice-contents identifier to point to a type of voice contents of a stereotypical sentence, prepares a speech style dictionary including speech style and prosody data which correspond to the voice-contents identifier, selects prosody data of the synthesized voice to be generated from the speech style dictionary, and adds the selected prosody data to a voice synthesizer 13 as voice-synthesizer driving data to thereby perform voice synthesis with a specific speech style. Thus, a voice of a stereotypical sentence can be synthesized with an arbitrary speech style.

16 Claims, 8 Drawing Sheets

FIG. 3

| IDENTIFIER | CONTENTS OF IDENTIFIER |
|---|---|
| ID.1 | MESSAGE INFORMING MAIL ARRIVAL |
| ID.2 | MESSAGE INFORMING CALL |
| ID.3 | MESSAGE INFORMING NAME OF SENDER |
| ID.4 | MESSAGE INFORMING ALARM INFORMATION |

FIG. 4

| IDENTIFIER | SENTENCE TO BE VOICE SYNTHESIZED |
|---|---|
| ID.1 | A MAIL HAS ARRIVED |
| ID.2 | THERE IS CALLING |
| ID.3 | CALLING FROM MR. ○ ○ |
| ID.4 | IT IS THE TIME OF ○ ○ |

FIG. 5

| IDENTIFIER | SENTENCE TO BE VOICE SYNTHESIZED |
|---|---|
| ID.1 | A MAIL HAS ARRIVED (OSAKA DIALECT) |
| ID.2 | THERE IS CALLING (OSAKA DIALECT) |
| ID.3 | CALLING FROM MR. ○ ○ (OSAKA DIALECT) |
| ID.4 | IT IS THE TIME OF ○ ○ (OSAKA DIALECT) |

FIG. 8

601

| PHONETIC SYMBOL (602) | DURATION (603) | INTENSITY (604) |
|---|---|---|
| m | 29 | 247 |
| e | 72 | 253 |
| e | 116 | 337 |
| r | 39 | 352 |
| u | 79 | 356 |
| g | 40 | 353 |
| a | 88 | 343 |
| k | 77 | 337 |
| i | 54 | 352 |
| t | 53 | 359 |
| e | 75 | 328 |
| m | 55 | 299 |
| a | 56 | 274 |
| Q | 125 | 234 |
| s | 78 | 214 |
| e | 65 | 202 |

605

606

VOICE SYNTHESIZING METHOD AND VOICE SYNTHESIZER PERFORMING THE SAME

BACKGROUND OF THE INVENTION

The present invention relates to a voice synthesizing method and a voice synthesizer and system which perform the method. More particularly, the invention relates to a voice synthesizing method which converts stereotypical sentences having nearly fixed contents to voice-synthesized sentences synthesized by a voice, a voice synthesizer which executes the method and a method of producing data necessary to achieve the method and voice synthesizer. Particularly, the invention is used in a communication network that comprises portable terminal devices each having a voice synthesizer and data communication means which is connectable to the portable terminal devices.

In general, voice synthesis is a scheme of generating a voice wave from phonetic symbols (voice element symbols) indicating the contents to be voiced, a time serial pattern of pitches (fundamental frequency pattern) which are physical measures of the intonation of voices, and the duration and power (voice element intensity) of each voice element. Hereinafter the three parameters, the fundamental-frequency pattern, the duration of a voice element and the voice element intensity, are generically called "prosodic parameters" and the combination of a voice element symbol and the prosodic parameters is generically called "prosody data".

Typical methods of generating voice waves are a parameter synthesizing method that drives a parameter which imitates the characteristics of a vocal tract of a voice element using a filter, and a wave concatenation method that generates waves by extracting pieces indicative of the characteristics of individual voice elements from a generated human voice wave and connecting them. Producing "prosody data" is important in voice synthesis. The voice synthesizing methods can be generally used for most languages including Japanese.

Voice synthesis needs to somehow acquire the prosodic parameters corresponding to the contents of a sentence to be voice-synthesized. In a case where the voice synthesizing technology is adapted to the readout or the like of electronic-mail and electronic newspaper, for example, an arbitrary sentence should be subjected to language analysis to identify the boundary between words or phrases and the accent type of a phrase should be determined after which prosodic parameters should be acquired from accent information, syllable information or the like. Those basic methods relating to automatic conversion have already been established and can be achieved by a method disclosed in "A Morphological Analyzer For A Japanese Text To Speech System Based On The Strength Of Connection Between Words" (in the Journal of the Acoustical Society of Japan, Vol. 51, No. 1, 1995, pp. 3–13).

Of the prosodic parameters, the duration of a syllable (voice element) varies due to various factors including a context where the syllable (voice element) is located. The factors that influence the duration include the restrictions on articulation, such as the type of the syllable, timing, the importance of a word, indication of the boundary of a phrase, the tempo in a phrase, the overall tempo, and the linguistic restriction, such as the meaning of a syntax. A typical way to control the duration of a voice element is to statistically analyze the degrees of influence of the factors on duration data that is actually observed, and use a rule acquired by the analysis. For example, "Phoneme Duration Control for Speech Synthesis by Rule" (The Transaction of the Institute of Electronics, Information and Communication Engineers, 1984/7, Vol. J67-A, No. 7) describes a method of computing the prosodic parameters. Of course, computation of the prosodic parameters is not limited to this method.

While the above-described voice synthesizing method relates to a method of converting an arbitrary sentence to prosodic parameters or a text voice synthesizing method, there is another method of computing prosodic parameters in a case of synthesizing a voice corresponding to a stereotypical sentence having predetermined contents to be synthesized. Voice synthesis of a stereotypical sentence, such as a sentence used in voice-based information notification or a voice announcement service using a telephone is not as complex as voice synthesis of any given sentence. It is therefore possible to store prosody data corresponding to the structures or patterns of sentences in a database and search the stored patterns and use prosodic parameters of a pattern similar to a pattern in question at the time of computing the prosodic parameters. This method can significantly improve the naturalness of a synthesized voice as compared with a synthesized voice which is acquired by the text voice synthesizing method. For example, Japanese Patent Laid-open No. 249677/1999 discloses the prosodic-parameter computing method which uses that method.

The intonation of a synthesized voice depends on the quality of prosodic parameters. The speech style of a synthesized voice, such as an emotional expression or a dialect, can be controlled by adequately controlling the intonation of a synthesized voice.

The conventional voice synthesizing schemes involving stereotypical sentences are mainly used in voice-based information notification or a voice announcement service using a telephone. In the actual usage of those schemes, however, synthesized voices are fixed to one speech style and multifarious voices, such as dialects and voices in foreign languages, cannot be freely synthesized as desired. There are demands for installing dialects or the like into devices which require some amusement, such as cellular phones and toys, and the scheme of providing voices in foreign languages are essential in the internationalization of the devices.

However, the conventional technology is not developed in consideration of arbitrary conversion of voice contents to each dialect or expression at the time of voice synthesis. Further, the conventional technology makes it hard for a third party other than a system user and operator to freely prepare the prosody data. Furthermore, a device which suffers considerably limited resources for computation, such as a cellular phone, cannot synthesize voices with various speech styles.

SUMMARY OF THE INVENTION

Accordingly, it is a primary object of the invention to provide a voice synthesizing method and voice synthesizer which synthesize voices with various speech styles for stereotypical sentences in a terminal device in which voice synthesizing means is installed.

It is another object of the invention to provide a prosody-data distributing method which can allow a third party other than the manufacture, owner and user of a voice synthesizer to prepare "prosody data" and allow the user of the voice synthesizer to use the data.

To achieve the objects, a voice synthesizing method according to the invention provides a plurality of voice-contents identifiers to specify the types of voice contents to be output in a synthesized voice, prepares a speech style dictionary storing prosody data of plural speech styles for each voice-contents identifier, points a desirable voice-contents identifier and speech style at the time of executing voice synthesis, reads the selected prosody data from the speech style dictionary and converts the read prosody data into a voice as voice-synthesizer driving data.

A voice synthesizer according to the invention comprises means for generating an identifier to identify a contents type which specifies the type of voice contents to be output in a synthesized voice, speech-style pointing means for selecting the speech style of voice contents to be output in the synthesized voice, a speech style dictionary containing a plurality of speech styles respectively corresponding to a plurality of voice-contents identifiers and prosody data associated with the voice-contents identifiers and speech styles, and a voice synthesizing part which, when a voice-contents identifier and a speech style are selected, reads prosody data associated with the selected voice-contents identifier and speech style from the speech style dictionary and converts the prosody data to a voice.

The speech style dictionary may be installed in a voice synthesizer or a portable terminal device equipped with a voice synthesizer beforehand at the time of manufacturing the voice synthesizer or the terminal device, or only prosody data associated with a necessary voice-contents identifier and arbitrary speech style may be loaded into the voice synthesizer or the terminal device over a communication network, or the speech style dictionary may be installed in a portable compact memory which is installable into the terminal device. The speech style dictionary may be prepared by disclosing a management method for voice contents to a third party other than the manufactures of terminal devices and the manager of the network and allowing the third party to prepare the speech style dictionary containing prosodic parameters associated with voice-contents identifiers according to the management method.

The invention can allow each developer of a program to be installed in a voice synthesizer or a terminal device equipped with a voice synthesizer to accomplish voice synthesis with the desired speech style only from information on a speech style pointer to point the speech style of a voice to be synthesized and a voice-contents identifier. Further, as a person who prepares a speech style dictionary has only to prepare the speech style dictionary corresponding to a sentence identifier without considering the operation of the synthesizing program, voice synthesis with the desired speech style can be achieved easily.

This and other advantages of the present invention will become apparent to those of skilled in the art upon reading and understanding the following description with reference to the accompanying figures.

BRIEF DESCRIPTION OF THE DRAWINGS

FIG. 3 is a diagram for explaining voice-contents identifiers;

FIG. 4 is a diagram showing sentences to be voice-synthesized with respect to identifiers of the standard language;

FIG. 5 is a diagram showing sentences to be voice-synthesized with respect to identifiers of the OsakaOsaka dialect;

FIG. 8 is a diagram showing a voice element table corresponding to the Osaka dialect "meiru ga kitemasse" in the speech style dictionary in FIG. 5;

DETAILED DESCRIPTION OF THE PREFERRED EMBODIMENTS

Figure 1:
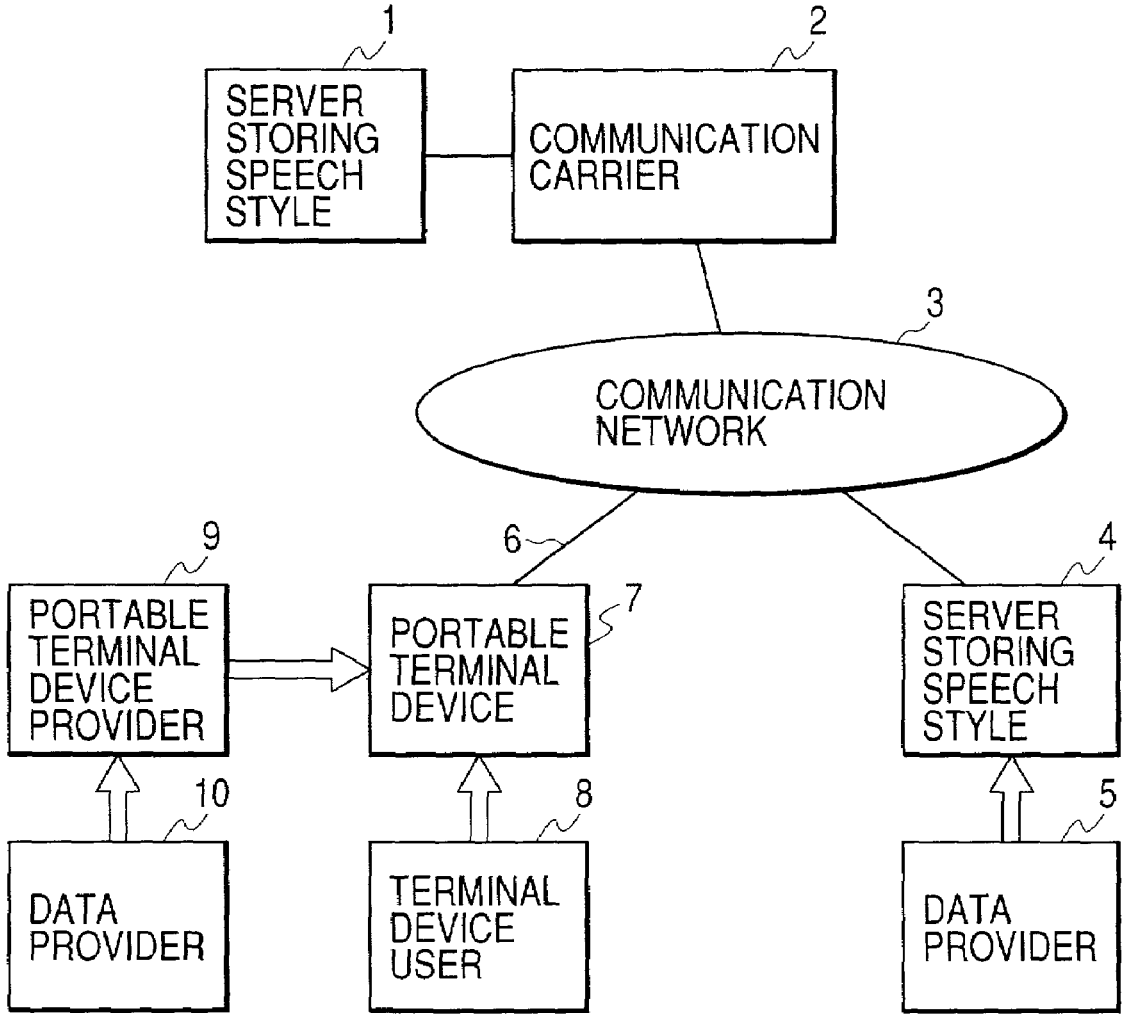
FIG. 1 is a block diagram illustrating one embodiment of an information distributing system which uses a voice synthesizer and a voice synthesizing method according to the invention.

FIG. 1 is a block diagram illustrating one embodiment of an information distributing system which uses a voice synthesizer and a voice synthesizing method according to the invention.

The information distributing system of the embodiment has a communication network 3 to which portable terminal devices (hereinafter simply called "terminal devices"), such as cellular phones, equipped with a voice synthesizer of the invention are connectable, and speech-styles storing servers 1 and 4 connected to the communication network 3. The terminal device 7 has means for selecting a speech style dictionary corresponding to a speech style pointed to by a terminal-device user 8, data transfer means for transferring the selected speech style dictionary to the terminal device from the server 1 or 4, and speech-style-dictionary storage means for storing the transferred speech style dictionary into a speech-style-dictionary memory in the terminal device 7, so that voice synthesis is carried out with the speech style selected by the terminal-device user 8.

A description will now be given of modes in which the terminal-device user 8 sets the speech style of a synthesized voice using the speech style dictionary.

A first method is a preinstall method which permits a terminal-device provider 9, such as a manufacturer, to install a speech style dictionary into the terminal device 7. In this case, a data creator 10 prepares the speech style dictionary and provides the portable-terminal-device provider 9 with the speech style dictionary. The portable-terminal-device provider 9 stores the speech style dictionary into the memory of the terminal device 7 and provides the terminal-device user 8 with the terminal device 7. In the first method, the terminal-device user 8 can set and change the speech style of an output voice since the beginning of the usage of the terminal device 7.

In a second method, a data creator 5 supplies a speech style dictionary to a communication carrier 2 which owns the communication network 3 to which the portable terminal devices 7 are connectable, and either the communication carrier 2 or the data creator 5 stores the speech style dictionary in the speech-styles storing server 1 or 4. When receiving a transfer (download) request for a speech style dictionary via the terminal device 7 from the terminal-device user 8, the communication carrier 2 determines if the portable terminal device 7 can acquire the speech style dictionary stored in the speech-styles storing server 1. At this time, the communication carrier 2 may charge the terminal-device user 8 for the communication fee or the download fee in accordance with the characteristic of the speech style dictionary.

In a third method, a third party 5 other than the terminal-device user 8, the terminal-device provider 9 and the communication carrier 2 prepares a speech style dictionary by referring to a voice-contents management list (associated data of an identifier that represents the type of a stereotyped sentence), and stores the speech style dictionary into the speech-styles storing server 4. When accessed by the terminal device 7 over the communication network 3, the server 4 permits downloading of the speech style dictionary in response to a request from the terminal-device user 8. The owner 8 of the terminal device 7 that has downloaded the speech style dictionary selects the desired speech style to set the speech style of a synthesized voice message (stereotyped sentence) to be output from the terminal device 7. At this time, the data creator 5 may charge the terminal-device user 8 for the license fee in accordance with the characteristic of the speech style dictionary through the communication carrier 2 as an agent.

Using any of the three methods, the terminal-device user 8 acquires the speech style dictionary for setting and changing the speech style of a synthesized voice to be output in the terminal device 7.

Figure 2:
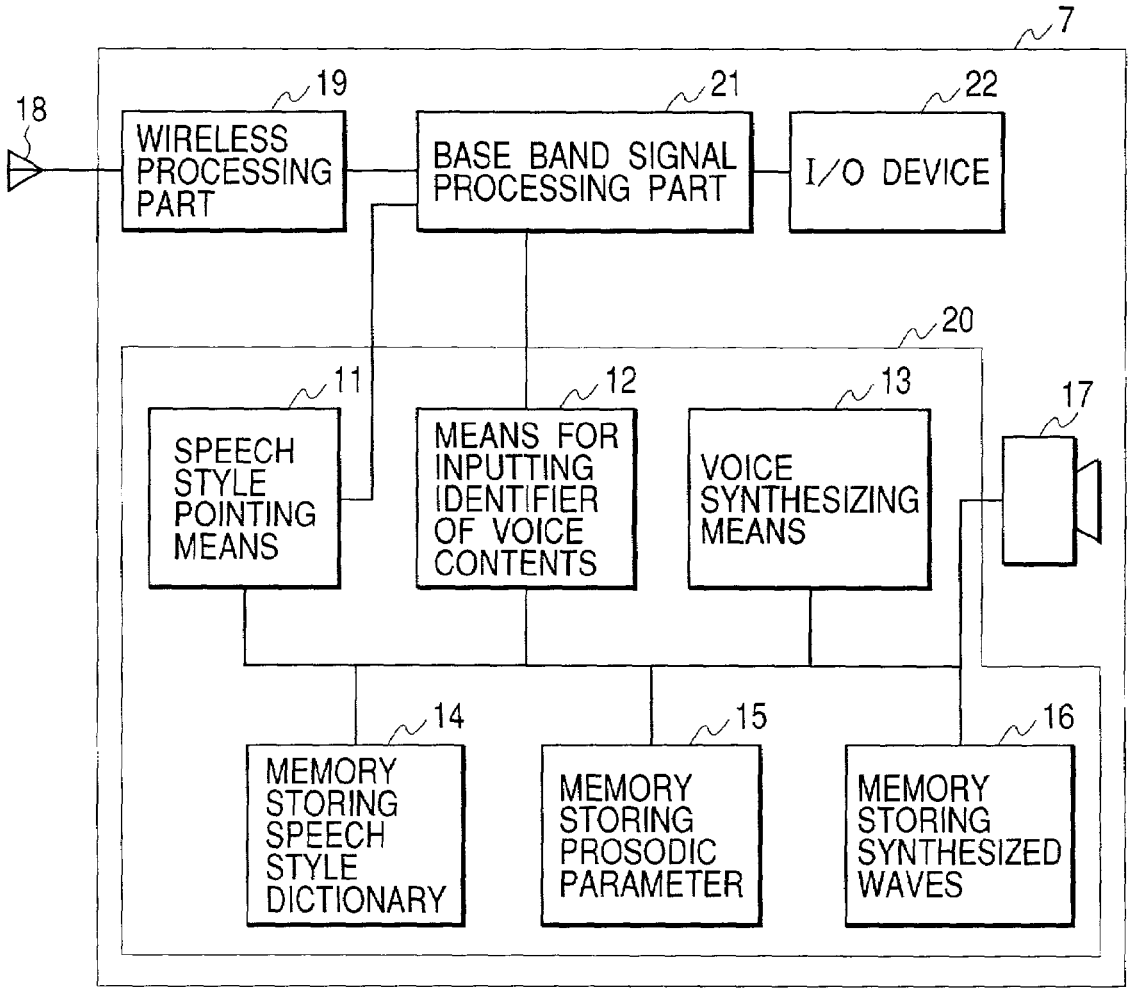
FIG. 2 is a diagram showing the structure of one embodiment of a cellular phone which is a terminal device equipped with the voice synthesizer of the invention.

FIG. 2 is a diagram showing the structure of one embodiment of a cellular phone which is a terminal device equipped with the voice synthesizer of the invention. The cellular phone 7 has an antenna 18, a wireless processing part 19, a base band signal processing part 21, an input/output part (input keys, a display part, etc.) and a voice synthesizer 20. Because the components other than the voice synthesizer 20 are the same as those of the prior art, their description will be omitted.

In the diagram, at the time of acquiring a speech style dictionary from outside the terminal device 7, speech style pointing means 11 in the voice synthesizer 20 acquires the speech style dictionary using a voice-contents identifier pointed to by voice-contents identifier inputting means 12. The voice-contents identifier inputting means 12 receives a voice-contents identifier. For example, the voice-contents identifier inputting means 12 automatically receives an identifier which represents a message informing mail arrival from the base band signal processing part 21 when the terminal device 7 has received an e-mail.

A speech-style-dictionary memory 14, which will be discussed in detail later, stores a speech style and prosody data corresponding to the voice-contents identifier. The data is either preinstalled or downloaded over the communication network 3. A prosodic-parameter memory 15 stores data of synthesized voices of a selected and specific speech style from the speech-style-dictionary memory 14. A synthesized-wave memory 16 converts data from the speech-style-dictionary memory 14 to a wave signal and stores the signal. A voice output part 17 outputs a wave signal, read from the synthesized-wave memory 16, as an acoustic signal, and also serves as a speaker of the cellular phone.

Voice synthesizing means 13 is a signal processing unit storing a program to drive and control the aforementioned individual means and the memories and execute voice synthesis. The voice synthesizing means 13 may be used as a CPU which executes other communication processes of the base band signal processing part 21. For the sake of descriptive convenience, the voice synthesizing means 13 is shown as a component of the voice synthesizing part.

FIG. 3 is a diagram for explaining the voice-contents identifier and shows a correlation list of a plurality of identifiers and voice contents represented by the identifiers. In the diagram, "message informing mail arrival", "message informing call", "message informing name of sender" and "message informing alarm information" which indicate the types of voice contents corresponding to identifiers "ID_1", "ID_2", "ID_3" and "ID_4" are respectively defined for the identifiers "ID_1", "ID_2", "ID_3" and "ID_4".

For the identifier "ID_4", the speech-style-dictionary creator 5 or 10 can prepare an arbitrary speech style dictionary for the "message informing alarm information". The relationship in FIG. 3 is not secret and is open to public as a document (voice-contents management data table). Needless to say, the relationship may be opened as electronic data on a computer or a network.

FIGS. 4 and 5 show sentences to be voice-synthesized in the standard language and the Osaka dialect with respect to an identifier as examples of different speech styles. FIG. 4 shows sentences to be voice-synthesized whose speech style is the standard language (hereinafter referred to as "standard patterns"). FIG. 5 shows sentences to be voice-synthesized whose speech style is the Osaka dialect (hereinafter referred to as "Osaka dialect"). For the identifier "ID.sub.—1", for example, the sentence to be voice-synthesized "meiru ga chakusin simasita" (which means "a mail has arrived" in English) in the standard pattern and "meiru ga kitemasse" (which also means "a mail has arrived" in English) in the Osaka dialect. Those wordings can be defined as desired by the creator who creates the speech style dictionary, and are not limited to those in the examples. For the identifier "ID_1" of the Osaka dialect, for example, the sentence to be voice-synthesized may be "kimasita, kimasita, meiru desse! " (which means "has arrived, has arrived, it is a mail!" in English). Alternatively, the stereotyped sentence may have a replaceable part (indicated by characters indicated by O) as in the identifier "ID_4" in FIG. 5.

Such data is effective at the time of reading information which cannot be prepared fixedly, such as sender information. The method of reading a stereotyped sentence can use the technique disclosed in "On the Control of Prosody Using Word and Sentences Prosody Database" (the Journal of the Acoustical Society of Japan, pp. 227–228, 1998).

Figure 6:
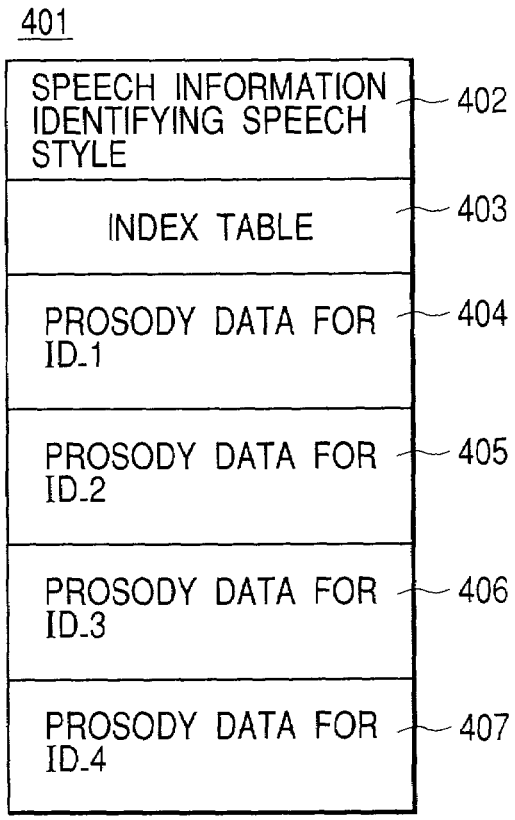
FIG. 6 is a diagram depicting the data structure of a speech style dictionary according to one embodiment.

FIG. 6 is a diagram depicting the data structure of the speech style dictionary according to one embodiment. The data structure is stored in the speech-style-dictionary memory 14 in FIG. 2. The speech style dictionary includes speech information 402 identifying a speech style, an index table 403 and prosody data 404 to 407 corresponding to the respective identifiers. The speech information 402 registers the type of the speech style of the speech style dictionary 14, such as "standard pattern" or "Osaka dialect". A characteristic identifier common to the system may be added to the speech style dictionary 14. The speech information 402 becomes key information at the time of selecting the speech style on the terminal device 7. Stored in the index table 403 is data indicative of the top address where the speech style dictionary corresponding to each identifier starts. The speech style dictionary corresponding to the identifier in question should be searched on the terminal device, and fast search is possible by managing the location of the speech style dictionary by means of the index table 403. In case where the prosody data 404 to 407 are set to have fixed lengths and are searched one by one, the index table 403 may not be needed.

Figure 7:
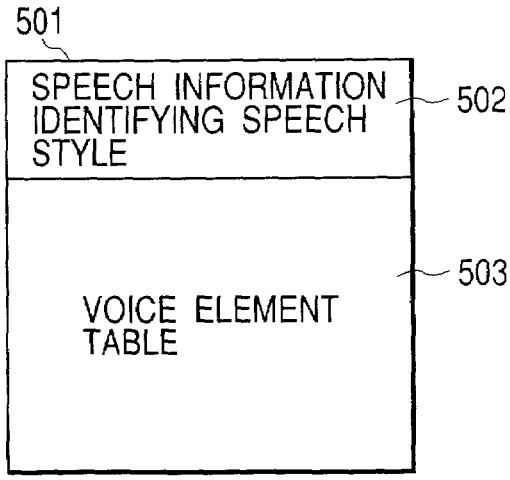
FIG. 7 is a diagram depicting the data structure of prosody data corresponding to each identifier shown in FIG. 6.

FIG. 7 shows the data structure of the prosody data 404 to 407 corresponding to the respective identifiers shown in FIG. 6. The data structure is stored in the prosodic-parameter memory 15 in FIG. 2. Prosody data 501 consists of a speech information 502 identifying a speech style and a voice element table 503. The voice-contents identifier of prosody data is described in the speech information 502. In the example of "ID_4" and "OO no jikan ni narimasita", for example, "ID_4" is described in the speech information 502. The voice element table 503-includes voice-synthesizer driving data or prosody data consisting of the phonetic symbols of a sentence to be voice-synthesized, the durations of the individual voice elements and the intensities of the voice elements. FIG. 8 shows one example of the voice element table corresponding to "meiru ga kitemasse" or the sentence to be voice-synthesized corresponding to the identifier "ID_1" in the speech style dictionary of the Osaka dialect. A voice element table 601 consists of phonetic symbol data 602, duration data 603 of each voice element and intensity data 604 of each voice element. Although the duration of each voice element is given in milliseconds, it is not limited to this unit but may be expressed in any physical quantity that can indicate the duration. Likewise, the intensity of each voice element which is given in hertzes (Hz) is not limited to this unit but may be expressed in any physical quantity that can indicate the intensity.

In this example, the phonetic symbols are "m/e/e/r/u/g/a/k/i/t/e/m/-a/Q/s/e" as shown in FIG. 8. The duration of the voice element "r" is 39 milliseconds and the intensity is 352 Hz (605). The phonetic symbol "Q" 606 means a choked sound.

Figure 9:
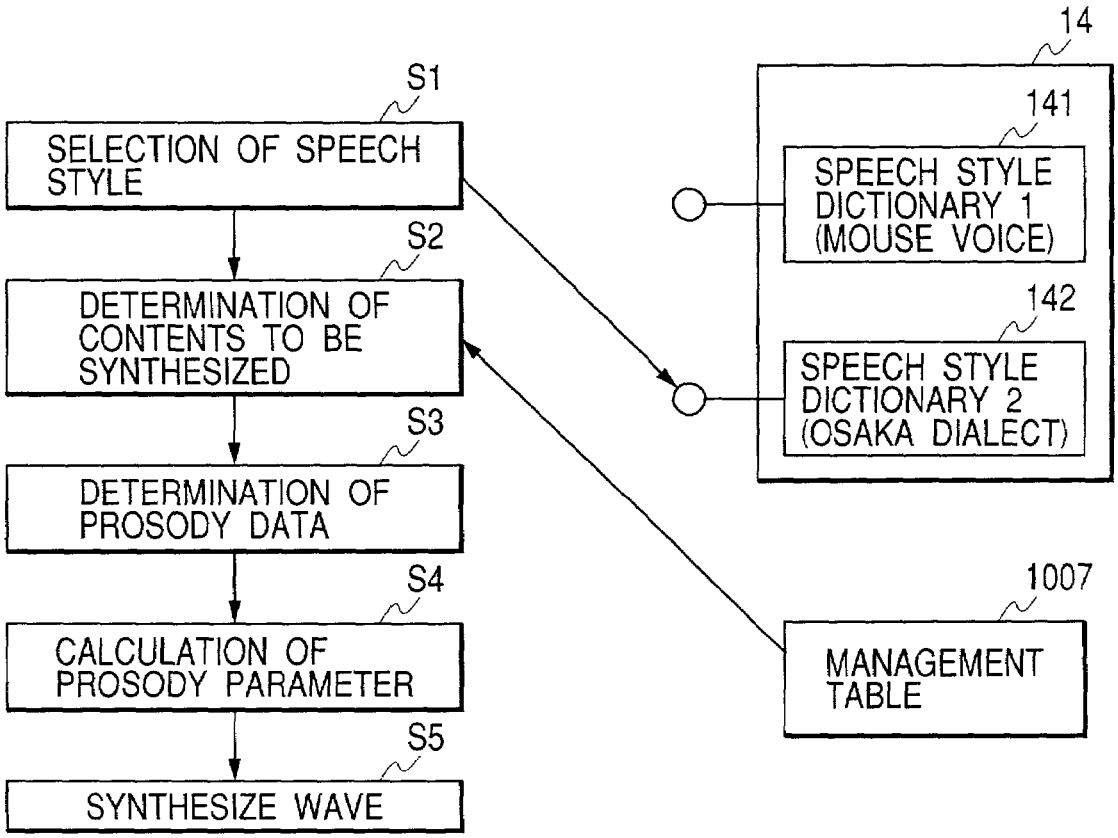
FIG. 9 is a diagram illustrating voice synthesis procedures according to one embodiment of the voice synthesizing method of the invention.

FIG. 9 illustrates voice synthesis procedures from the selection of a speech style to the generation of a synthesized voice wave according to one embodiment of the voice synthesizing method of the invention. The example illustrates the procedures of the method by which the user of the terminal device 7 in FIG. 2 selects a synthesis speech style of "Osaka dialect" and a message in a synthesized voice is generated when a call comes. A management table 1007 stores telephone numbers and information on the names of persons that are used to determine the voice contents when a call comes.

To synthesize a wave in the above example, first, a speech style dictionary in the speech-style-dictionary memory 14 is switched based on the speech style information input from the speech style pointing means 11 (S1). The speech style dictionary 1 (141) or the speech style dictionary 2 (142) is stored in the speech-style-dictionary memory 14. When the terminal device 7 receives a call, the voice-contents identifier inputting means 12 determines the synthesis of "message informing call" using the identifier "ID_2" to set prosody data for the identifier "ID_2" as the synthesis target (S2). Next, prosody data to be generated is determined (S3). In this example, the sentence does not have words that are to be replaced as desired, no particular process is performed. In the case of using the voice contents of, for example, "ID_3" in FIG. 5, however, the name information of the caller is acquired from the management table 1007 (provided in the base band signal processing part 21 in FIG. 2) and prosody data "suzukisan karayadee" is determined.

After the prosody data is determined in the above manner, the voice element table as shown in FIG. 8 is computed (S4). To synthesize a wave using "ID_2" in the example, prosody data stored in the speech-style-dictionary memory 14 has only to be transferred to the prosodic-parameter memory 15.

But, in the case of using the voice contents of "ID_3" in FIG. 5, for example, the name information of the caller is acquired from the management table 1007 and prosody data "suzukisan karayadee" is determined. The prosodic parameters for the part "suzuki" are computed and are transferred to the prosodic-parameter memory 15. The computation of the prosodic parameters for the part "suzuki" may be accomplished by using the method disclosed in "On the Control of Prosody Using Word and Sentences Prosody Database" (the Journal of the Acoustical Society of Japan, pp. 227–228, 1998).

Finally, the voice synthesizing means 13 reads the prosodic parameters from the prosodic-parameter memory 15, converts the prosodic parameters to synthesized wave data and stores the data in the synthesized-wave memory 16 (S5). The synthesized wave data in the synthesized-wave memory 16 is sequentially output as a synthesized voice by a voice output part or electroacoustic transducer 17.

Figure 10A:
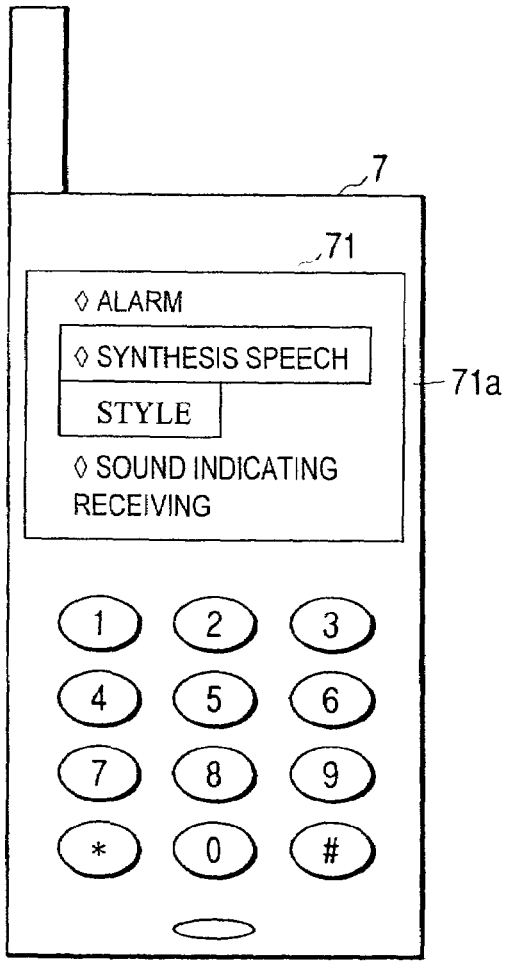
FIG. 10 is a diagram showing a display part according to one embodiment of a cellular phone according to the invention.
Figure 10B:
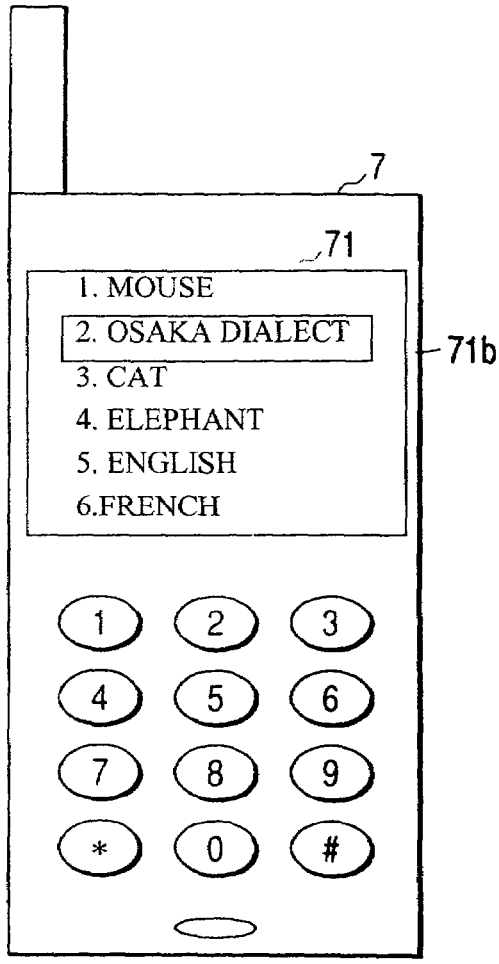
Figure 11A:
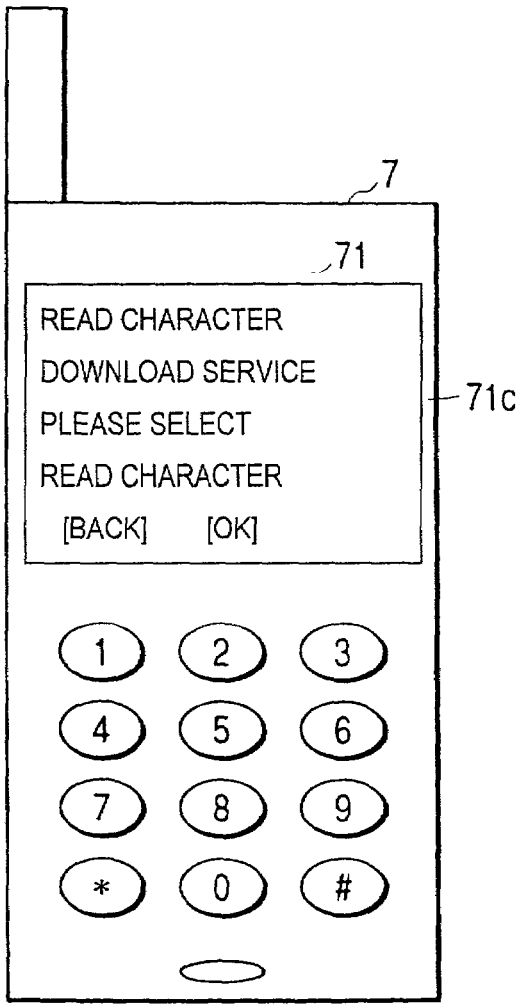
FIG. 11 is a diagram showing the display part according to the embodiment of the cellular phone according to the invention.
Figure 11B:
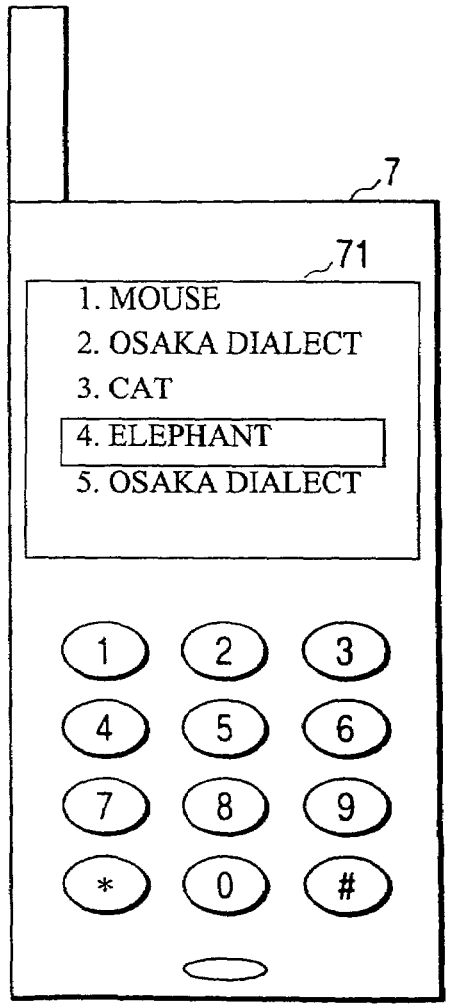

FIGS. 10 and 11 are diagrams each showing a display of the portable terminal device equipped with the voice synthesizer of the invention at the time the speech style of a synthesized voice is selected. The terminal-device user 8 selects a menu "SET UP SYNTHESIS SPEECH STYLE" on a display 71 of the portable terminal device 7. In FIG. 10A, a "SET UP SYNTHESIS SPEECH STYLE" menu 71*a* is accomplished in the same layer as "SET UP ALARM" and "SET UP SOUND INDICATING RECEIVING". The "SET UP SYNTHESIS SPEECH STYLE" menu 71*a* need not be in the same layer but may be achieved by another method as long as the function of setting up synthesis speech style is realized. After the "SET UP SYNTHESIS SPEECH STYLE" menu 71*a* is selected, the synthesis speech styles registered in the portable terminal device 7 are shown on the display 71 as shown in FIG. 10B. The string of characters displayed is the one stored in the speech information 402 in FIG. 6. When the speech style dictionary consists of data prepared in such a way as to generate voices which are generated by a personified mouse, for example, "nezumide chu" (which means "it is a mouse" in English). Of course, any string of characters which indicates the characteristic of the selected speech style dictionary may be used. In case where the terminal-device user 8 intends to synthesize a voice in the "Osaka dialect", for example, "OSAKA DIALECT" 71*b* is highlighted to select the corresponding synthesis speech style. The speech style dictionary is not limited to a Japanese one, but an English or French speech style dictionary may be provided, or English or French phonetic symbols may be stored in the speech style dictionary.

FIG. 11 is a diagram showing the display part of the portable terminal device to explain a method of allowing the terminal-device user 8 in FIG. 1 to acquire a speech style dictionary over the communication network 3. The illustrated display is given when the portable terminal device 7 is connected to the information management server over the communication network 3. FIG. 11A shows the display after the portable terminal device 7 is connected to the speech-style-dictionary distributing service.

First, the display 71 to check whether or not to acquire synthesized speech style data is given to the terminal-device user 8. When "OK" 71*c* which indicates acceptance is selected, the display 71 is switched to (b) and a list of speech style dictionaries registered in the information management server is displayed. A speech style dictionary for an imitation voice of a mouse "nezumide chu", a speech style dictionary for messages in an Osaka dialect, and so forth are registered in the server.

Next, the terminal-device user 8 moves the highlighted display to the speech style data to be acquired and depresses the acceptance (OK) button. The information management server 1 sends the speech style dictionary corresponding to the requested speech style to the communication network 3.

After the transmission is completed, the transmission and reception of the speech style dictionary is completed. Through the above-described procedures, the speech style dictionary that has not been installed in the terminal device 7 is stored in the terminal device 7. Although the above-described method acquires data by accessing the server that is provided by the communication carrier, a third party 5 who is not the communication carrier may of course access the speech-styles storing server 4 to acquire the data.

The invention can ensure easy development of a portable terminal device capable of reading stereotyped information in an arbitrary speech style.

Various other modification will be apparent to read and can be readily made by those skilled in the art without departing from the scope and spirit of this invention. Accordingly, the above description and illustrations should not be construed as limiting the scope of the invention, which is defined by the appended claims.

The invention claimed is:

1. A voice synthesizing method comprising steps of:

selecting a speech style for a voice to be synthesized;

determining a voice-contents of a stereotypical sentence to be synthesized;

selecting prosody data of said stereotypical sentence, which corresponds to the selected voice-contents and which is in the same language as the voice-contents, from a speech style dictionary which corresponds to the selected speech style; and inputting said selected prosody data to a voice-synthesizer that performs voice synthesis of the selected prosody data and outputs a voice of the stereotypical sentence of the selected speech style.

2. The voice synthesizing method according to claim 1, wherein said prosody data comprises at least a sequence of phonetic symbols that are voice elements into which said voice contents of said stereotypical sentence are composed, and information on a duration, an intensity and power of each of the voice elements constituting said sequence of phonetic symbols.

3. A voice synthesizing method according to claim 1, wherein the speech style further includes foreign languages; and the step of selecting prosody data selects a stereotypical sentence in said foreign languages, which is different from the language of the voice-contents, when the foreign language is selected as the speech style.

4. A voice synthesizer according to claim 1, further comprising:

a step of determining a word to be inserted in a replaceable part in the stereotypical sentences and calculates a prosody data of the word; and synthesizes the voice signal by inserting the prosody data of the input word to the replaceable part in the stereotypical sentences.

5. A voice synthesizer according to claim 1, wherein the voice-contents is selected by selecting a voice-content identifier identifying voice contents.

6. A voice synthesizer, comprising:

a memory for storing a speech style dictionary in which speech-style information that specifies a speech style for a voice to be synthesized and prosody data of a plurality of stereotypical sentences each of which corresponds to predetermined voice contents and which is in the same language as the voice-contents are associated with each other;

pointing means for pointing to one said predetermined voice-contents and one said speech style of a voice to be synthesized at a time of voice synthesis; and said voice synthesizing part selecting said prosody data of the stereotypical sentence which corresponds to the pointed voice-contents and the pointed speech style from said speech style dictionary and converting said prosody data to a voice signal.

7. The voice synthesizer according to claim 6, wherein said prosody data comprises at least a sequence of phonetic symbols that are voice elements into which said voice contents of said stereotypical sentence are composed, and information on a duration, an intensity and power of each of the voice elements constituting said sequence of phonetic symbols.

8. A cellular phone having a voice synthesizer as recited in claim 6.

9. A voice synthesizer according to claim 6, wherein the speech style further includes foreign languages; and the voice synthesizing part selects a stereotypical sentence in said foreign languages, which is different from the language of the voice-contents, when the foreign language is selected as the speech style.

10. A voice synthesizer according to claim 6, wherein the memory further stores information of the stereotypical sentences each of which associated to the corresponds prosody data.

11. A voice synthesizer according to claim 6, wherein the voice synthesizing part determines a word to be inserted in a replaceable part in the stereotypical sentences and calculates a prosody data of the word, and synthesizes the voice signal by inserting the prosody data of the input word to the replaceable part in the stereotypical sentences.

12. A prosody-data distributing method comprising steps of:

receiving an input specifying a speech style;

preparing a speech style dictionary that corresponds to the specified speech style which includes prosody data of a plurality of stereotypical sentences each of which corresponds to a predetermined voice contents and is in the same language as the voice-contents; and supplying said speech style dictionary to a server provided in a communication network or a terminal device connected via said server;

so that the server and the terminal device can perform voice synthesis of the stereotypical sentence, when an input of specifying voice-content and speech style is input, using the supplied speech style dictionary.

13. The prosody-data distributing method according to claim 12, wherein said prosody data comprises at least a sequence phonetic symbols that are voice elements into which said voice contents of and said stereotypical sentence are composed, and information on a duration, an intensity and power of each of the voice elements constituting said sequence of phonetic symbols.

14. The prosody-data distributing method according to claim 13, wherein said prosody data is supplied by referring to a management list of the predetermined voice contents which is open to public.

15. The prosody-data distributing method according to claim 12, wherein said supplying of said speech style dictionary to said terminal device further includes selecting a speech style dictionary corresponding to a speech style pointed to by a user's terminal-device transferring said selected speech style dictionary to said terminal device from said server, and storing said transferred speech style dictionary into a speech-style-dictionary memory in said terminal device, so that voice synthesis is carried out with said speech style pointed to by said terminal-device user.

16. A prosody-data distributing method according to claim 12, wherein the speech dictionary further includes information of the plurality of stereotypical sentences.

* * * * *